US008296990B2

(12) United States Patent
Zukowski et al.

(10) Patent No.: US 8,296,990 B2
(45) Date of Patent: Oct. 30, 2012

(54) SNAP-ON DOVETAIL PISTOL SIGHT

(75) Inventors: Gary Zukowski, Ludlow, MA (US); Brett Curry, Munson, MA (US); Sean O'Clair, Feeding Hills, MA (US)

(73) Assignee: Smith & Wesson Corp., Springfield, MA (US)

( * ) Notice: Subject to any disclaimer, the term of this patent is extended or adjusted under 35 U.S.C. 154(b) by 378 days.

(21) Appl. No.: 12/650,217

(22) Filed: Dec. 30, 2009

(65) Prior Publication Data

US 2010/0170138 A1 Jul. 8, 2010

Related U.S. Application Data

(60) Provisional application No. 61/141,503, filed on Dec. 30, 2008.

(51) Int. Cl.
*F41G 1/00* (2006.01)

(52) U.S. Cl. ..... 42/111

(58) Field of Classification Search ..... 42/90, 111, 42/124, 127, 148; 29/505
See application file for complete search history.

(56) References Cited

U.S. PATENT DOCUMENTS 875,016 A * 12/1907 Uren et al. ..... 42/148
1,393,912 A 10/1921 Searle
1,618,225 A * 2/1927 Redfield ..... 42/140
1,852,875 A * 4/1932 Endrezze ..... 42/144
2,123,273 A * 7/1938 Burton ..... 42/148
2,975,680 A 3/1961 Wilson
3,656,400 A 4/1972 Stoner et al.
3,724,113 A 4/1973 Ludwig
3,750,531 A 8/1973 Angell et al.
3,774,500 A 11/1973 Into
3,830,002 A 8/1974 Volkmar
3,857,325 A 12/1974 Thomas
4,011,678 A 3/1977 Brodbeck et al.
4,021,955 A 5/1977 Curtis
4,031,648 A 6/1977 Thomas
4,161,836 A 7/1979 Hayashi
4,199,886 A 4/1980 Deuring
4,207,798 A 6/1980 Hayashi
4,306,487 A 12/1981 Beretta
4,344,246 A 8/1982 Bauman et al.
4,409,882 A 10/1983 Blackshaw et al.
4,522,105 A 6/1985 Atchisson
4,525,052 A * 6/1985 Kosugi et al. ..... 396/419
4,539,889 A 9/1985 Glock
4,542,606 A 9/1985 Hoenig
4,555,861 A 12/1985 Khoury
4,575,963 A 3/1986 Ruger et al.
4,589,327 A 5/1986 Smith
4,594,935 A 6/1986 Smith
4,602,450 A 7/1986 Hoenig
4,825,744 A 5/1989 Glock
4,843,748 A 7/1989 Tuma
4,893,546 A 1/1990 Glock
4,926,739 A 5/1990 Byron
4,967,724 A 11/1990 Senfter
5,012,604 A 5/1991 Rogers
5,016,382 A * 5/1991 Pickle ..... 42/148

(Continued)

*Primary Examiner* — Jonathan C Weber
(74) *Attorney, Agent, or Firm* — Ballard Spahr LLP

(57) ABSTRACT

A firearm has a frame, a slide mounted to the frame, and a configurable sight that is removably connected to the slide using a combined transverse dovetail- and longitudinal lap-shaped protrusion and slot engagement. The configurable sight can be quickly and easily installed by hand without the use of tools.

8 Claims, 8 Drawing Sheets

U.S. PATENT DOCUMENTS

| | | | | |
|---|---|---|---|---|
| 5,018,292 | A | 5/1991 | West | |
| 5,024,139 | A | 6/1991 | Knight, Jr. et al. | |
| 5,036,612 | A | 8/1991 | Jennings | |
| 5,050,480 | A | 9/1991 | Knight, Jr. et al. | |
| 5,050,481 | A | 9/1991 | Knight, Jr. et al. | |
| 5,081,780 | A | 1/1992 | Lishness et al. | |
| 5,086,578 | A | 2/1992 | Lishness et al. | |
| 5,086,579 | A | 2/1992 | Flatley et al. | |
| 5,088,222 | A | 2/1992 | Larson | |
| 5,090,147 | A | 2/1992 | Pastor | |
| 5,105,570 | A | 4/1992 | Lishness et al. | |
| 5,115,588 | A | 5/1992 | Bronsart et al. | |
| 5,119,634 | A | 6/1992 | Berry et al. | |
| 5,149,898 | A | 9/1992 | Chesnut et al. | |
| 5,157,209 | A | 10/1992 | Dunn | |
| 5,159,137 | A | 10/1992 | Brennan | |
| 5,160,796 | A | 11/1992 | Tuma et al. | |
| 5,164,534 | A | 11/1992 | Royster | |
| 5,166,458 | A | 11/1992 | Yoo | |
| 5,187,312 | A | 2/1993 | Osborne | |
| 5,195,226 | A | 3/1993 | Bornancini | |
| 5,202,524 | A * | 4/1993 | Nechushtan | 42/132 |
| 5,216,191 | A | 6/1993 | Fox | |
| 5,216,195 | A | 6/1993 | Tuma | |
| 5,225,612 | A | 7/1993 | Bernkrant | |
| 5,235,770 | A | 8/1993 | Simon et al. | |
| 5,241,769 | A | 9/1993 | Von Muller | |
| 5,245,776 | A | 9/1993 | Domaus | |
| 5,247,757 | A | 9/1993 | Deeb | |
| 5,251,394 | A | 10/1993 | Bornancini | |
| 5,259,138 | A | 11/1993 | Scirica | |
| 5,267,407 | A | 12/1993 | Bornancini | |
| 5,272,957 | A | 12/1993 | Chesnut et al. | |
| 5,299,374 | A | 4/1994 | Mathys | |
| 5,303,494 | A | 4/1994 | Tuma et al. | |
| 5,327,810 | A | 7/1994 | Sandusky et al. | |
| 5,349,939 | A | 9/1994 | Perrone | |
| 5,355,768 | A | 10/1994 | Felk | |
| 5,373,775 | A | 12/1994 | Findlay, Sr. et al. | |
| 5,386,659 | A | 2/1995 | Vaid et al. | |
| 5,388,362 | A | 2/1995 | Melcher | |
| 5,400,537 | A | 3/1995 | Meller et al. | |
| 5,404,667 | A * | 4/1995 | Schmitter | 42/111 |
| 5,406,731 | A | 4/1995 | Stevens | |
| 5,412,894 | A | 5/1995 | Moon | |
| 5,417,001 | A | 5/1995 | Rousseau | |
| 5,426,881 | A | 6/1995 | Ruger | |
| 5,438,784 | A | 8/1995 | Lenkarski et al. | |
| 5,448,939 | A | 9/1995 | Findlay, Sr. et al. | |
| 5,467,550 | A | 11/1995 | Mumbleau | |
| 5,487,233 | A | 1/1996 | Jewell | |
| 5,493,806 | A | 2/1996 | Langevin et al. | |
| 5,502,914 | A | 4/1996 | Moon | |
| 5,517,896 | A | 5/1996 | Perrine | |
| 5,517,897 | A | 5/1996 | Perrine | |
| 5,548,914 | A | 8/1996 | Anderson | |
| 5,570,527 | A | 11/1996 | Felicci | |
| 5,581,927 | A | 12/1996 | Meller | |
| 5,604,326 | A | 2/1997 | Lescure | |
| 5,606,825 | A | 3/1997 | Olsen | |
| 5,615,507 | A | 4/1997 | French | |
| 5,623,114 | A | 4/1997 | Soper | |
| 5,625,971 | A | 5/1997 | Tuma et al. | |
| 5,634,456 | A | 6/1997 | Perrone | |
| 5,635,664 | A | 6/1997 | Pons et al. | |
| 5,640,794 | A | 6/1997 | Gardner et al. | |
| 5,655,326 | A | 8/1997 | Levavi et al. | |
| 5,666,754 | A | 9/1997 | De Oliveira Masina | |
| 5,669,169 | A | 9/1997 | Schmitter et al. | |
| 5,671,560 | A | 9/1997 | Meller | |
| 5,680,722 | A | 10/1997 | French et al. | |
| 5,697,178 | A | 12/1997 | Haskell | |
| 5,701,698 | A | 12/1997 | Wesp et al. | |
| 5,709,046 | A | 1/1998 | Canaday | |
| 5,711,286 | A | 1/1998 | Petrosyan et al. | |
| 5,713,150 | A | 2/1998 | Ealovega | |
| 5,717,156 | A | 2/1998 | Lenkarski | |
| 5,718,074 | A | 2/1998 | Keeney | |
| 5,734,120 | A | 3/1998 | Besselink | |
| 5,736,667 | A | 4/1998 | Munostes et al. | |
| 5,741,996 | A | 4/1998 | Ruger et al. | |
| 5,760,328 | A | 6/1998 | Robbins | |
| 5,770,814 | A | 6/1998 | Ealovega | |
| 5,778,585 | A | 7/1998 | Sigg | |
| 5,778,587 | A | 7/1998 | Brandl et al. | |
| 5,797,206 | A | 8/1998 | Vitorino | |
| 5,806,225 | A | 9/1998 | Gardner et al. | |
| 5,815,973 | A | 10/1998 | Hochstrate | |
| 5,826,362 | A | 10/1998 | Lyons | |
| 5,834,678 | A | 11/1998 | Kalb | |
| 5,852,891 | A | 12/1998 | Onishi et al. | |
| 5,857,280 | A | 1/1999 | Jewell | |
| 5,878,521 | A * | 3/1999 | Warnock | 42/145 |
| 5,903,994 | A | 5/1999 | Tange | |
| 5,906,066 | A | 5/1999 | Felk | |
| 5,913,261 | A | 6/1999 | Guhring et al. | |
| 5,924,232 | A | 7/1999 | Rhoden et al. | |
| 5,974,717 | A | 11/1999 | Brooks | |
| 5,983,773 | A | 11/1999 | Dionne | |
| 5,987,796 | A | 11/1999 | Brooks | |
| 6,000,162 | A | 12/1999 | Hochstrate | |
| 6,070,512 | A | 6/2000 | Rohrbaugh | |
| 6,112,636 | A | 9/2000 | Besselink | |
| 6,125,735 | A | 10/2000 | Guhring | |
| 6,131,324 | A | 10/2000 | Jewell | |
| 6,134,852 | A | 10/2000 | Shipman et al. | |
| 6,145,234 | A | 11/2000 | Fluhr | |
| 6,164,001 | A | 12/2000 | Lee | |
| 6,205,694 | B1 | 3/2001 | Davis, Sr. | |
| 6,230,414 | B1 * | 5/2001 | Glock | 42/139 |
| 6,234,059 | B1 | 5/2001 | Fuchs | |
| 6,240,669 | B1 | 6/2001 | Spaniel et al. | |
| 6,253,479 | B1 | 7/2001 | Fuchs et al. | |
| 6,256,918 | B1 | 7/2001 | Szabo | |
| 6,256,920 | B1 | 7/2001 | Olson | |
| 6,263,607 | B1 | 7/2001 | Fuchs et al. | |
| 6,266,909 | B1 | 7/2001 | Fuchs et al. | |
| 6,272,683 | B1 | 8/2001 | Symms et al. | |
| 6,272,783 | B1 | 8/2001 | Dumortier et al. | |
| 6,289,619 | B1 | 9/2001 | Fuchs et al. | |
| 6,293,039 | B1 | 9/2001 | Fuchs | |
| 6,341,442 | B1 | 1/2002 | Szabo et al. | |
| 6,349,495 | B1 | 2/2002 | Fluhr | |
| 6,354,032 | B1 | 3/2002 | Viani | |
| 6,367,186 | B1 | 4/2002 | Gibala | |
| 6,381,892 | B1 | 5/2002 | Szabo et al. | |
| 6,382,200 | B1 | 5/2002 | Levkov | |
| 6,393,751 | B1 | 5/2002 | Liebenberg | |
| 6,401,379 | B1 | 6/2002 | Moon | |
| 6,405,631 | B1 | 6/2002 | Milek | |
| 6,412,206 | B1 | 7/2002 | Strayer | |
| 6,415,702 | B1 | 7/2002 | Szabo et al. | |
| 6,418,655 | B1 | 7/2002 | Kay | |
| 6,425,199 | B1 | 7/2002 | Vaid et al. | |
| 6,448,939 | B2 | 9/2002 | Maruta | |
| 6,513,273 | B2 | 2/2003 | Da Silveira | |
| 6,519,887 | B1 | 2/2003 | Allen et al. | |
| 6,523,294 | B2 | 2/2003 | Curry et al. | |
| 6,539,658 | B1 | 4/2003 | Huber et al. | |
| 6,543,169 | B2 | 4/2003 | Bero | |
| 6,553,706 | B1 | 4/2003 | Gancarz et al. | |
| 6,557,288 | B2 | 5/2003 | Szabo | |
| 6,560,909 | B2 | 5/2003 | Cominolli | |
| 6,588,136 | B2 | 7/2003 | Baker et al. | |
| 6,615,527 | B1 | 9/2003 | Martin | |
| 6,640,478 | B2 | 11/2003 | Johansson | |
| 6,643,968 | B2 | 11/2003 | Glock | |
| 6,665,066 | B2 | 12/2003 | Nair et al. | |
| 6,665,973 | B1 | 12/2003 | Peev | |
| 6,688,210 | B2 | 2/2004 | Bubits | |
| 6,705,036 | B2 | 3/2004 | Orr | |
| 6,711,824 | B2 | 3/2004 | Hruska | |
| 6,711,842 | B1 | 3/2004 | Chapman | |
| 6,718,680 | B2 | 4/2004 | Roca et al. | |
| 6,732,464 | B2 | 5/2004 | Kurvinen | |
| 6,735,897 | B1 | 5/2004 | Schmitter et al. | |
| 6,769,208 | B2 | 8/2004 | Beretta | |

6,789,342 B2 9/2004 Wonisch et al.
6,865,839 B2 3/2005 Bantle et al.
6,931,779 B1 * 8/2005 Galuppo, Jr. ..... 42/127
7,069,683 B1 7/2006 Kapusta
7,204,051 B2 4/2007 Thomele et al.
7,213,359 B2 5/2007 Beretta
7,296,376 B2 * 11/2007 Kidd ..... 42/136
7,421,935 B2 9/2008 Ho et al.
7,451,681 B2 11/2008 Ho et al.
7,562,486 B2 * 7/2009 LoRocco ..... 42/132
7,703,230 B2 4/2010 Curry et al.
7,743,546 B2 * 6/2010 Keng ..... 42/145
7,941,954 B2 5/2011 Carr et al.
8,033,043 B2 10/2011 McGarry
2002/0194762 A1 12/2002 Cominolli
2003/0233147 A1 * 12/2003 Nicholson et al. ..... 623/17.16
2005/0229459 A1 * 10/2005 McGarry ..... 42/7
2005/0229462 A1 10/2005 McGarry
2006/0048428 A1 3/2006 Thomele et al.
2006/0162220 A1 7/2006 Curry et al.
2006/0207157 A1 * 9/2006 Keng ..... 42/132
2006/0265924 A1 11/2006 Bubits
2007/0193569 A1 8/2007 Ho et al.
2007/0234625 A1 * 10/2007 Kidd ..... 42/111
2008/0092424 A1 * 4/2008 Keng ..... 42/137
2008/0104874 A1 5/2008 Kiesel
2008/0148618 A1 6/2008 McGarry
2009/0013581 A1 * 1/2009 LoRocco ..... 42/132
2009/0071053 A1 3/2009 Thomele et al.
2010/0170131 A1 7/2010 Zukowski
2010/0170132 A1 7/2010 Zukowski
2010/0170138 A1 7/2010 Zukowski
2011/0219656 A1 9/2011 McGarry

* cited by examiner

SNAP-ON DOVETAIL PISTOL SIGHT

CROSS REFERENCE TO RELATED APPLICATIONS

This application claims the benefit of U.S. Provisional Application Ser. No. 61/141,503, filed on Dec. 30, 2008, herein incorporated by reference in its entirety. This application is related to U.S. Non-Provisional Application Serial No. 12/650,038 entitled AN AUTOMATIC FIRING PIN BLOCK SAFETY FOR A FIREARM filed on Dec. 30, 2009, and U.S. Non-Provisional Application Ser. No. 12/650,124 entitled A MANUAL SLIDE AND HAMMER LOCK SAFETY FOR A FIREARM filed on Dec. 30, 2009, herein incorporated by reference in their entirety.

FIELD OF THE INVENTION

The present invention relates generally to a sight for a firearm and more particularly to a configurable sight for a semi-automatic pistol.

BACKGROUND OF THE INVENTION

Fire control mechanisms used in semi-automatic firearms oftentimes utilize hammer-initiated firing pins. In firearms that employ this design, the trigger is connected to a trigger bar. Movement of the trigger causes movement of the trigger bar, which in certain embodiments ultimately releases a hammer in a forward rotation about a pivot point. Upon rotation, the hammer strikes the rear of the firing pin, which drives the firing pin towards a chambered round of ammunition.

However, even if the trigger is not activated, the firing pin may, in certain designs, be urged forward to strike the primer if the firearm is agitated or disturbed, thereby discharging the firearm. For example, certain prior art firearms can experience an accidental discharge if dropped, particularly, on the rear portion of the firearm. What is needed is an improved locking device that prevents the firing of a firearm unless the trigger is actuated.

Various devices have been used to prevent the discharge of firearms resulting from a muzzle drop. Such devices include firing pin safeties that incapacitate axial movement of the firing pin. Firing pin safeties typically consist of a mating element that is pivotally mounted adjacent to the firing pin such that, when the trigger is not actuated, the firing pin safety rests against the firing pin, thereby blocking the forward motion of the firing pin. However, such firing pin safeties can involve complex mechanism and are difficult to install within the frame of the firearm.

In addition to trigger-actuated firing control mechanisms, various other devices are often used to prevent the discharge of a firearm, for example, when the firearm is not in use. Such devices have included grip safeties, trigger locks, and slide locks.

Although the aforesaid devices can be effective, they generally are so effective at disabling the firearm that it can be awkward to re-activate the firearm. What is needed is an improved locking device that prevents the firing of a firearm but which can be activated and deactivated easily.

A contributing factor to the accurate discharge of a firearm is the sight, which enhances the user's ability to aim the firearm while firing. Sights are known in the art, however, there are opportunities for improvement. Most firearms have front and rear sights which may or may not be adjustable. The front sight is typically pinned into a cutout or relieved slot in the slide. The process of pinning the sight in place can be a time consuming step of the manufacture of a firearm. What is needed is a front sight that can be installed quickly and easily.

There are also new opportunities present with such a readily installed sight. What is needed is a sight that can be customized to serve a diverse range of aesthetic and functional purposes that were not practicable in prior designs.

SUMMARY OF THE INVENTION

A firearm, in general, includes a frame having a top surface and defining an inner cavity having a firing pin channel, a slide reciprocally mounted to the top surface, a trigger rotatably mounted to the frame, and a hammer-type firing mechanism including a hammer rotatably mounted in the inner cavity and connected to the trigger via a trigger bar and a firing pin reciprocally disposed in the firing pin channel and engageable with the hammer.

It is an object of the present invention to provide a firearm that includes a configurable sight.

For instance, the firearm further includes a configurable sight and the slide further comprises a transverse slot and a pair of longitudinal slots. The configurable sight includes a lower portion and an upper portion having wings that engage the transverse and longitudinal slots, respectively. The lower portion and transverse slot form a dovetail-shaped engagement oriented laterally across the top surface of the slide. The wings and longitudinal slot form a double lap-shaped engagement oriented along the longitudinal axis of the top surface of the slide. The sight is made from a slightly compliant material that, during installation, elastically deforms under pressure allowing the lower portion of the sight to slide snuggly through the transverse slot and the wings to deform upwardly away from the corner of the slide and then snap into the longitudinal slot.

It is an object of the present invention to provide a configurable sight that is capable of quick and easy installation by hand without the use of tools.

It is an object of the present invention to provide a configurable sight that the user can select according to the user's preference. Sights of various forms, sizes, and aesthetics can be fitted to a firearm depending upon whether the firearm is to be displayed, stored or used for target shooting, competitive target shooting, hunting, personal protection or any other shooting activity.

According to one embodiment of the present invention, a configurable sight for a firearm is provided. The firearm has a slide, the slide defining a dovetail-shaped transverse slot and a longitudinal slot that connects to the transverse slot and runs parallel to the slide. The configurable sight includes a lower portion that is fitted to a transverse slot, and an upper portion having a wing that is fitted to a longitudinal slot, wherein the wing snap fits into engagement with a longitudinal slot when the lower portion is inserted into a transverse slot.

According to one embodiment of the present invention, a configurable sight for a firearm is provided. The firearm has a top surface with a width and a longitudinal firing axis, the top surface defining a longitudinal slot that runs parallel to the longitudinal firing axis and a transverse slot that connects to each transverse side of the longitudinal slot. The configurable sight includes a lower portion that is fitted to a transverse slot, and an upper portion having wings that are substantially fitted to a longitudinal slot, wherein the lower portion has a dovetail shape and extends transversely to the top surface by less than or equal to a width of the top surface, wherein the wings have a flat-lap shape, wherein the wings snap fit into engagement with a longitudinal slot when the lower portion is inserted into a transverse slot, wherein the wings are configured to extend slightly beyond a longitudinal slot, and wherein, when snap fitted into engagement with the longitudinal slot, the wings remain slightly deformed.

According to one embodiment of the present invention, a method for installing a configurable sight to a firearm is provided. The firearm has a top surface defining a transverse slot and a longitudinal slot connected to the transverse slot. The method includes sliding a lower portion of the configurable sight laterally into the transverse slot until wings of an upper portion of the configurable sight abut the top surface of the firearm, squeezing the wings in the longitudinal direction to deform the wings away from the top surface, and while squeezing the upper portion, sliding the lower portion further into the transverse slot until the wings snap fit into the longitudinal slot.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENT

Figure 1:
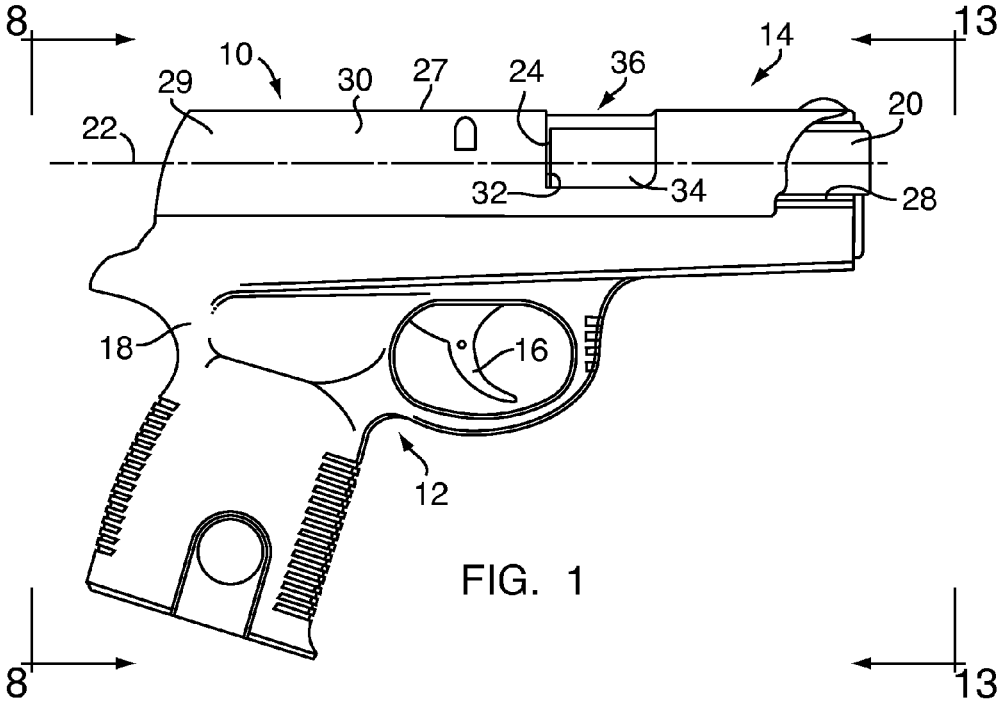
FIG. 1 is a simplified schematic side view of a semi-automatic firearm provided in accordance with the present invention.
Figure 2:
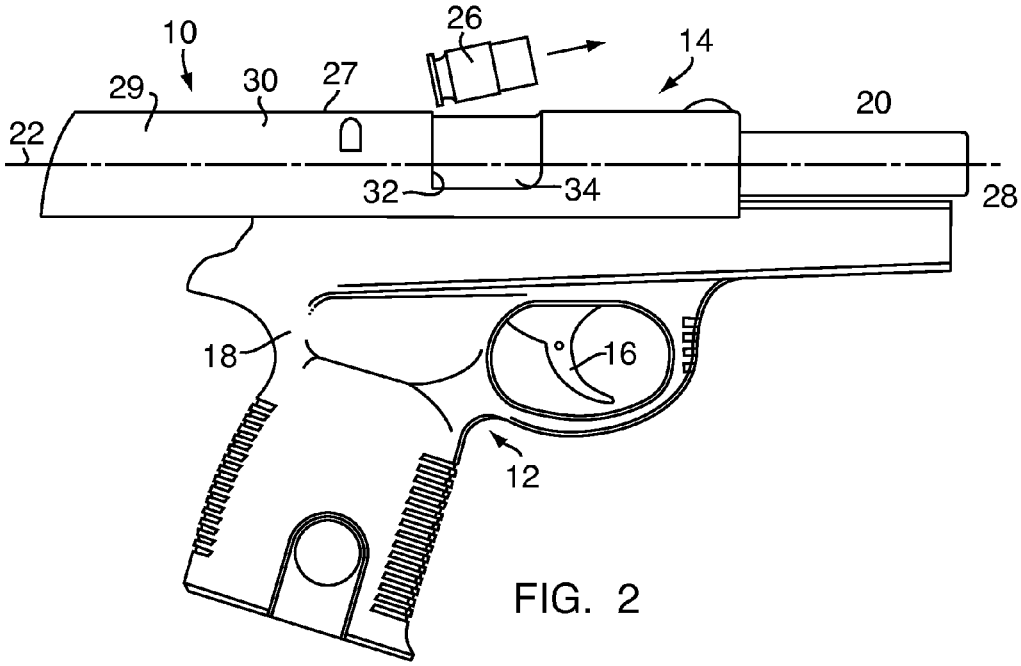
FIG. 2 is a simplified schematic side elevation view of the firearm of FIG. 1 shown with the slide moved to a rearward position on the firearm frame.

FIGS. 1 and 2 show one example of a firearm, handgun or semi-automatic pistol (hereinafter referred to as "firearm 10") that may incorporate an automatic firing pin block safety mechanism 100, a manual slide and hammer lock safety mechanism 200, and a configurable sight 300 according to an embodiment of the present invention. The firearm 10 includes a frame 12, a slide 14, a trigger 16, an automatic firing pin block safety mechanism 100 (hereinafter referred to as "automatic safety 100") (see FIGS. 3-8) that operates via actuation of the trigger 16, a manual slide and hammer lock and hammer lock safety mechanism 200 (hereinafter referred to as "manual safety 200") (see FIGS. 9-11) that operates via actuation of a rotatable tab 202 and a configurable sight 300 (see FIGS. 12-13) that removably connects to the slide 14. The frame 12 includes a grip body 18 for holding the firearm 10 and is fabricated of a high-impact polymer material, metal, a combination of polymer and metal, or other suitable material. The slide 14 houses a barrel 20 in the forward end thereof. The barrel 20 is cooperatively linked with the slide 14 and, together with the slide 14, defines a longitudinal firing axis 22. A rearward end 24 of the barrel 20 is adapted for receiving an ammunition cartridge 26. The frame 12, the slide 14 and the barrel 20, depending on the specific configuration of the firearm 10, define a top surface 27.

The slide 14 is fitted to oppositely positioned rails 28 on each side 29 of the frame 12 to effect the reciprocal movement of the slide 14 along the longitudinal firing axis 22. The rails 28 extend along the underside of the slide 14 in the longitudinal direction and are cooperative with the frame 12 to allow the cycling of the slide 14 between forward (battery) and rearward (retired) positions. The slide 14, which is defined by a slide frame 30, further includes a breech face 32 and an extractor port 34. The breech face 32 is engageable with the rearward end 24 of the barrel 20 to form a firing chamber 36 when the slide 14 is disposed forwardly on the frame 12 as shown in FIG. 1. An ejection mechanism (ejector 38 and extractor pin 39, see FIGS. 4-5) provides for the ejection of an ammunition cartridge 26 casing upon firing the firearm 10 or manually cycling the slide 14.

The cooperation of the frame 12, the slide 14, the barrel 20, and the firing mechanism during the loading, firing, and ejecting of an ammunition cartridge 26 or a cartridge casing can be understood by referring to U.S. Pat. No. 5,086,579 entitled "DECOCKING MECHANISM FOR A SEMI-AUTOMATIC FIREARM"; U.S. Pat. No. 5,386,659 entitled "FIRE CONTROL MECHANISM FOR SEMI-AUTOMATIC FIREARMS"; and U.S. Pat. No. 5,406,731 entitled "HANDGUN OF IMPROVED ERGONOMIC CONSTRUCTION," all of which are owned by the assignee of the present invention and are incorporated by reference herein.

Figure 3:
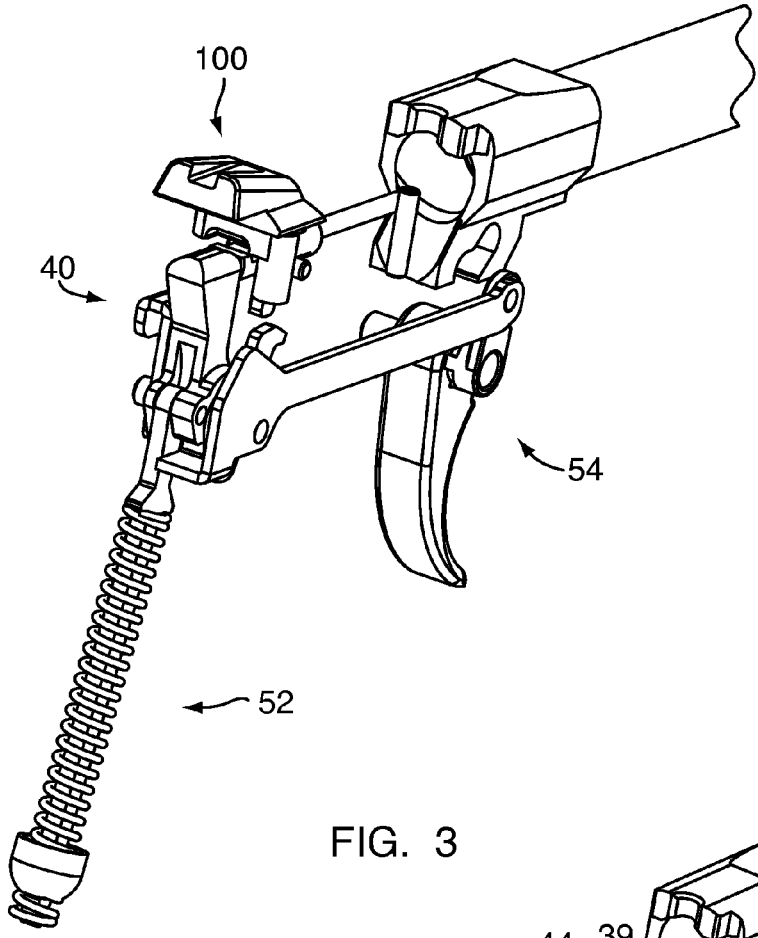
FIG. 3 is a simplified schematic perspective view of the firing mechanism of the semi-automatic firearm of FIG. 1 including an automatic firing pin block safety mechanism according to an embodiment of the present invention.

Referring now to FIG. 3, the firing mechanism 40 including a sear assembly 52, a trigger assembly 54 and the automatic safety 100 is shown.

Figure 4:
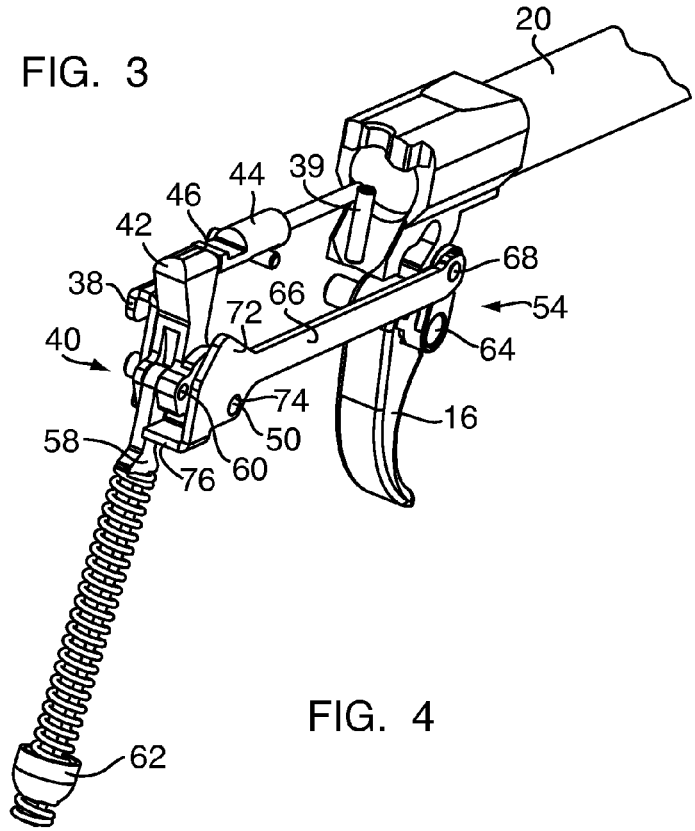
FIG. 4 is a simplified schematic perspective view of a hammer assembly, sear assembly and trigger assembly portions of the semi-automatic firearm of FIG. 3.
Figure 5:
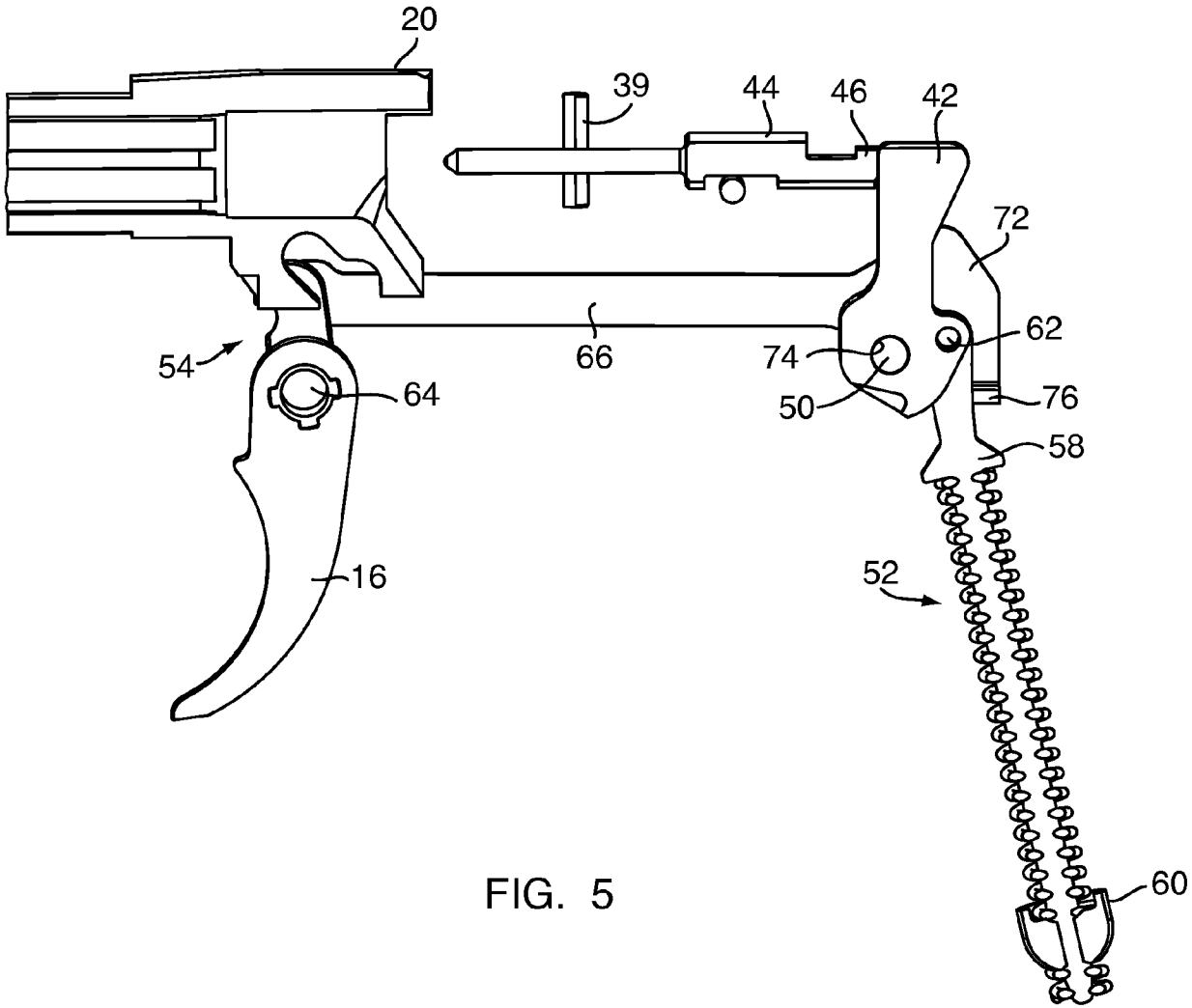
FIG. 5 is a simplified schematic side view of a cross section of the automatic firing pin block safety of FIG. 4.

Referring to FIGS. 4 and 5, the firing mechanism 40 is of a hammer-type and includes a hammer 42 and a firing pin 44 configuration. The firing pin 44 is a thin pin-shaped member housed inside a firing pin channel 48 (see FIG. 8) that is co-axial to the barrel 20. The frontward end of the firing pin 44 engages with a round of ammunition (not shown) that is chambered in the rear of the barrel 20, which causes the round to discharge. The rearward end of the firing pin 44 has a substantially cylindrical protruding portion including a rearmost lobe 46. The rearmost lobe 46 is characterized by a shallow flat radial indentation separated from the rest of the cylindrical protruding portion by an upper flat indentation on an upper surface of the firing pin 44. The firing pin 44 also has a frontward lobe that is characterized by a lower flat indentation on a lower surface of the firing pin 44. A roller engages the lower flat indentation in order to retain the firing pin 44 in the firing pin channel 48.

The hammer 42 is pivotally mounted about hammer pin 50, which is positioned slightly below the firing pin channel 48 such that distal end of the hammer 42 rotates into contact with the rear face of the rearmost lobe 46 at the rear opening of the firing pin channel 48.

Figure 8:
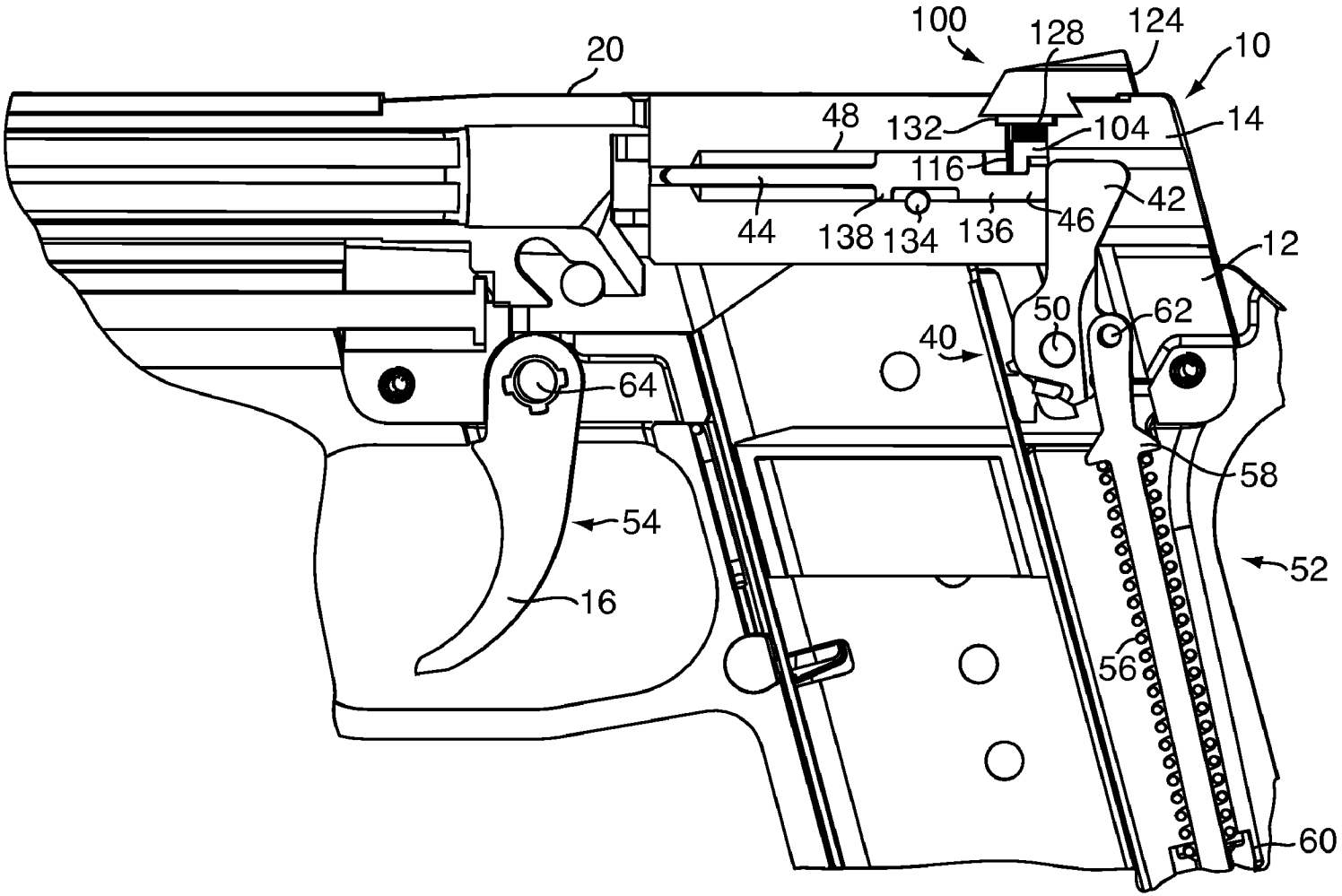
FIG. 8 is a side view of a cross section of the automatic firing pin block safety of FIG. 7.

The sear assembly 52 includes a sear 58 housed in a sear channel 56 (see FIG. 8). One end of the sear 58 engages the hammer 42 at a hammer strut 60 and the second end of the sear 58 is rotatably mounted in a recess at the base of the grip body via a grip cap 62. The hammer strut 60 is positioned along the hammer 42 radially outward (i.e., rearward and upward) from the hammer pin 50 and, preferably, near the center of the rear face of the hammer 42.

The trigger assembly 54 includes a trigger 16 and a trigger bar 66 that functionally connects the trigger 16 to the firing mechanism 40. The trigger 16 is rotatably mounted about trigger pivot 64 positioned near the center of the lower edge of the frame 12. The trigger 16 may be of unitary construction or of a multiple-piece articulated construction, as shown.

One end of the trigger bar 66 is connected to the trigger 16 at trigger bar pin 68, which is located on the remote side of the trigger pivot 64 from the trigger 16. The second end of the trigger bar 66 is connected to the firing mechanism 40 at hammer pin 50 and includes a trigger bar extension 72.

The trigger bar extension 72 extends from the rear of the trigger bar 66 into the sear channel 56 (see FIG. 8) and forms an annular opening 74 that circumscribes the hammer pin 50, keeping the trigger bar 66 properly aligned with the frame 12, and a trigger bar tab 76 that laterally extends from the bottom of the rear of the trigger bar extension 72. In some circumstances, such as a rearward actuation of the trigger bar 66, the trigger bar extension 72 engages and actuates the sear 58 rearward, which, in turn, causes the hammer 42 to rotate backwards thereby, at least partially, cocking the firearm. In other circumstances, such as a forward actuation of the trigger bar 66, the trigger bar tab 76 engages and actuates the automatic safety as discussed hereinafter.

Figure 7:
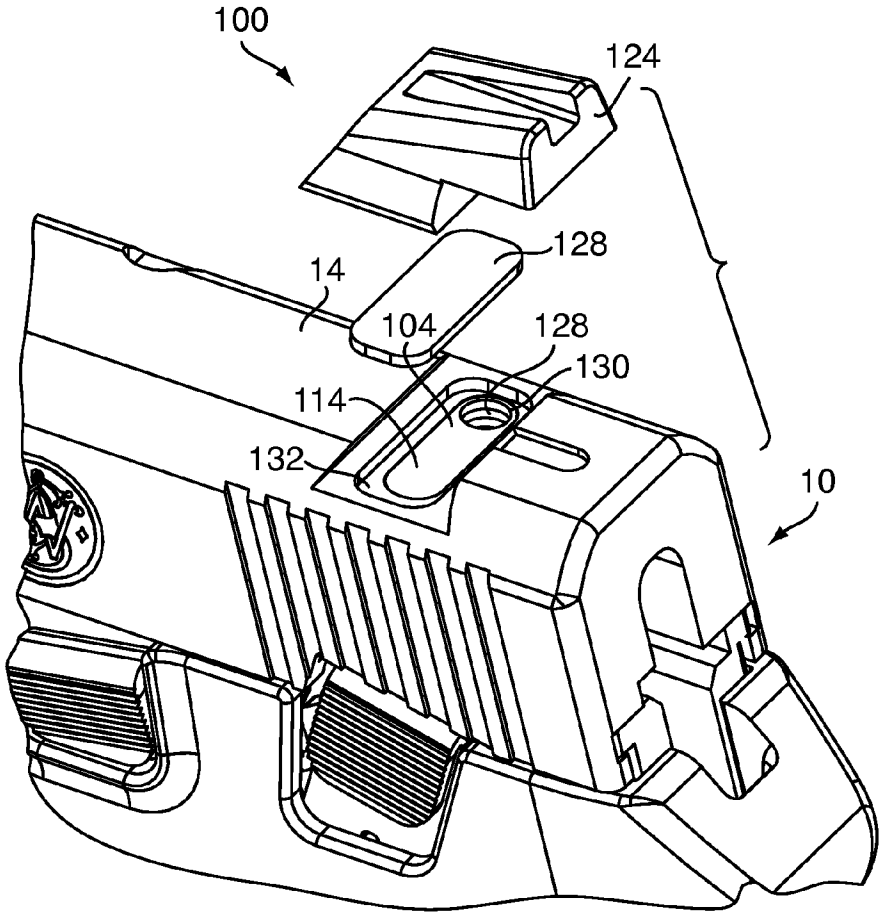
FIG. 7 is a view of the automatic firing pin block safety of FIG. 6 with the rear sight and rear sight spacer elevated for illustrative purposes.
Figure 6:
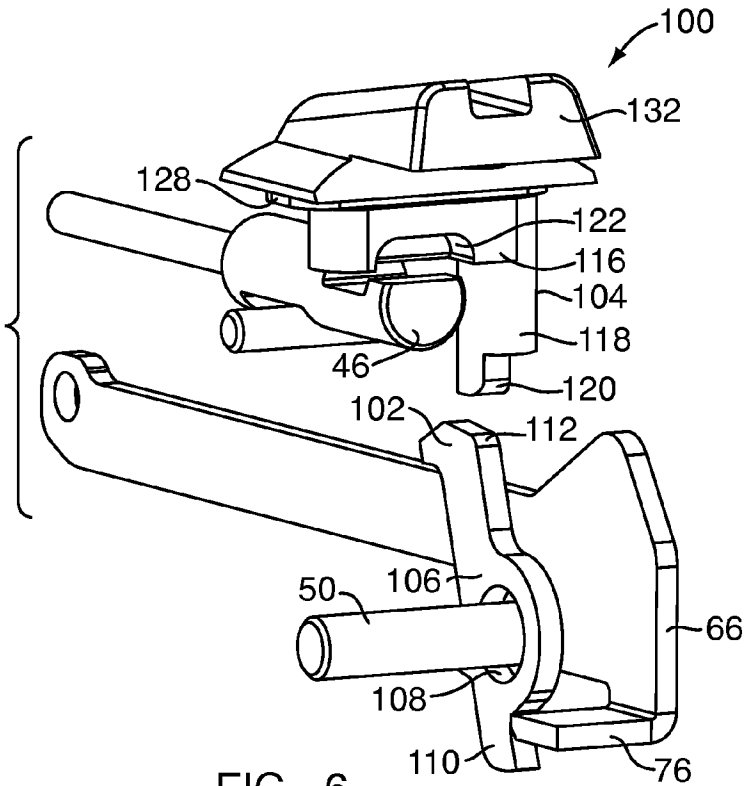
FIG. 6 is a simplified schematic perspective view of the firing pin, the trigger bar and the automatic firing pin block safety mechanism portions of the semi-automatic firearm of FIG. 3.

Referring to FIGS. 6-8, the automatic safety is shown at 100. The automatic safety 100 includes a pin lock arm 102 rotatably mounted on hammer pin 50 and a flange-like pin lock safety 104 (hereinafter referred to as "flange 104") actuated by the pin lock arm 102. The pivot lock arm 102 includes a center portion 106 having a hole 108 for rotatably engaging the hammer pin 50, a first arm portion 110 and a second arm portion 112. The first arm portion 110 is a substantially straight protrusion that extends downward from the center portion 106 along the front side of the pin lock arm 102 and, under some circumstances, is engaged by the trigger bar tab 76, for example, when the trigger is actuated and the trigger bar 66 moves forward. The second arm portion 112 is a curved protrusion that extends upward and forward from the center portion 106 along the front side of the pin lock arm 102 and, under some circumstances, engages and actuates the flange 104.

The flange 104 is slidably spring mounted in a vertical bore 114 in the top surface 27 of the slide 14. The vertical bore 114 adjoins the firing pin channel 48 at a position that substantially overlies the resting or un-actuated position of the rearmost lobe 46 of the firing pin 44 within the firing pin channel 48. The flange 104 includes a flange body portion 116 that engages the rearmost lobe 46 and a flange protrusion 118 that extends downward from the flange body portion 116 and ends in a longitudinally rounded tip 120. The longitudinal rounded tip 120 culminates within the movement path of the second arm portion 112.

The flange body portion 116 laterally traverses the upper surface of the firing pin 44 across the width of the vertical bore 114 and includes a cylindrical recess 122 that receives the firing pin 44. The cylindrical recess 122 is a substantially cylindrical carve-out fitted to receive the radial outer surface of the rearmost lobe 46 and formed along the rear edge of the bottom of the flange body portion 116. Accordingly, it is the rearward vertical surface of the cylindrical recess 122 that engages the forward vertical surface of the rearmost lobe 46 and, thus, blocks the firing pin 44 from moving forward unless and until the trigger 16 is actuated.

Referring to FIG. 7, the firearm 10 is illustrated with a rear sight 124 and a rear sight spacer 126 elevated above the slide 14 to reveal the flange 104. In normal operation, the flange 104 is pressed downward through the vertical bore 114 by a flange compressing spring 128 mounted in a narrow vertical bore 130 in the flange protrusion 118. The flange compressing spring 128 is held in place by a rear sight spacer 126. The rear sight spacer 126, in turn, is held in place in an enlarged recess 132 at the top of the vertical bore 114 under the pressure of the rear sight 124 which is detachably connected to the slide 14 using a dovetail-shaped engagement.

Referring now to FIG. 8, a cross section of the automatic safety 100 is shown in relation to the firing mechanism 40. In FIG. 8, the firearm is shown in an "off" position (i.e. a disabled configuration): the hammer 42 is not cocked, the cylindrical recess 122 of flange 104 is engaged with the rearmost lobe 46 and the firing chamber is empty.

FIG. 8 illustrates various elements of the firearm 10 in relation to the frame 12 and slide 14. For instance, the sear channel 56 that houses the sear assembly 53 is positioned substantially vertically in the rear of the firearm 10. The firing pin channel 48 that houses the firing pin 44 is positioned in the slide 14 along the longitudinal firing axis. The vertical bore 114 that houses the flange 104 is positioned vertically above the rear end of the firing pin channel 48. The firing pin 44 is shown as having three lobes sized to fit the firing pin channel 48. The rearmost lobe 46 is contacted by the hammer 42 and the flange 104. The other two lobes 136, 138 are shaped to receive a pin roller 134 housed in the firing pin channel 48. The pin roller 134 is a laterally mounted rotatable cylinder that is located between the middle and front lobes 136, 138 and is sized such that the radius of the pin roller 134 extends from the wall of the firing pin channel 48 to the outer surface of the narrow pin-like portion of the firing pin 44. The pin roller 134 is provided for retaining the firing pin 44 within the firing pin channel 48. At the foremost portion of the firing pin channel 48, an opening is provided for allowing the firing pin 44 to make contact with a chambered round of ammunition (not shown).

Referring to FIGS. 3-8, the operation of the firearm 10 including automatic safety 100 is as follows. When the user desires to discharge a round of ammunition from the firing chamber of a firearm 10, the user squeezes the trigger 16, which moves the trigger 16 rearward. The rearward movement of the trigger 16 translates to a forward movement of the trigger bar 66 as the trigger 16 rotates about trigger pivot 64 drawing the trigger bar 66 forward. The forward movement of the trigger bar 66, in turn, corresponds with a forward movement of the trigger bar tab 76. The trigger bar tab 76 actuates the first arm portion 110 causing a rotation of the pin lock arm 102 about hammer pin 50. The second arm portion 112, as a result of the rotation of the pin lock arm 102, rotates rearward causing the longer radial portion of the curved second arm portion 112 to displace the flange protrusion 118 upward against the pressure of the flange compressing spring 128. The upward displacement of the flange protrusion 118 corresponds to an upward movement of the flange body portion 116, which causes the cylindrical recess 122 to disengage from the firing pin 44. As the firing pin 44 is disengaged, the firing pin 44 becomes unblocked and may move forward and backward in the firing pin channel 48. Accordingly, normal unobstructed operation of the firearm 10 is possible.

Disengagement of the automatic safety 100 occurs automatically upon rearward movement of the trigger 16 without the user disengaging the automatic safety 100 as a separate or distinct action. Specifically, as the trigger bar 66 is urged backward, the flange 104 disengages the rearmost lobe 46. Once the flange 104 is moved upward to its retracted position, the flange 104 no longer lies in blocking engagement or abutment with the firing pin 44. This allows the firing pin 44 to move forward and backward.

However, when the user does not desire to discharge the firearm 10, the trigger 16 is released and returns to the unactuated position. Accordingly, the trigger 16 rotates forward and the trigger bar 66 is pressed backwards. The rearward movement of the trigger bar 66 corresponds with a rearward movement of trigger bar tab 76. As trigger bar tab 76 moves backwards, trigger bar tab 76 disengages the first arm portion 110 leaving the pin arm lock 102 free to rotate under other forces. In particular, the downward pressure of the flange 104, generated by the flange compressing spring 128, is transferred through the flange protrusion 118 to the second arm portion 112, which causes the pin lock arm 102 to rotate out of engagement with the flange 104. As a result, the flange 104 moves downward into contact with the firing pin 44 such that the cylindrical portion 122 engages the rearmost lobe 46, once again. The firearm 10 is, thus, disabled.

Accordingly, during operation, the flange 104 normally lies in its safety position (i.e., resting downward upon the firing pin 44). Here, the flange 104 blocks the rearmost lobe 46 of the firing pin 44, preventing the firing pin 44 from moving forward. This is true even if either the sear 58 or the hammer 42 is somehow disturbed, causing the hammer 42 to spring forward into the firing pin 42 without rearward movement of the trigger bar 66. Thus, the automatic safety 100 prevents the firing pin 44 from moving forward and discharging the firearm unless and until the trigger 16 is actuated.

As should be appreciated, the automatic safety 100 is configured, in relation to the firing mechanism 40, the sear assembly 52 and the trigger assembly 54, so that the following occurs in succession as the trigger 16 is pulled rearward: (i) the flange 104 is urged upward in the direction of its retracted position; (ii) the flange 104 reaches its retracted, non-safety position; and (iii) the sear 58 is pivoted downward out of engagement with the hammer 42. The latter action will typically occur either simultaneously with or just slightly after the flange 104 reaches its retracted position out of blocking engagement with the firing pin 44.

As should be appreciated, the amount that the trigger 16 needs to be compressed to disengage the flange 104 from the firing pin 44 can be altered by adjusting the size of the flange 104, the diameter and size of the rearmost lobe 46 or the responsiveness of the pin lock arm 102 to the rear movement of the trigger bar 66, which is itself partly dependent upon the characteristics of the flange compressing spring 128.

Figure 9:
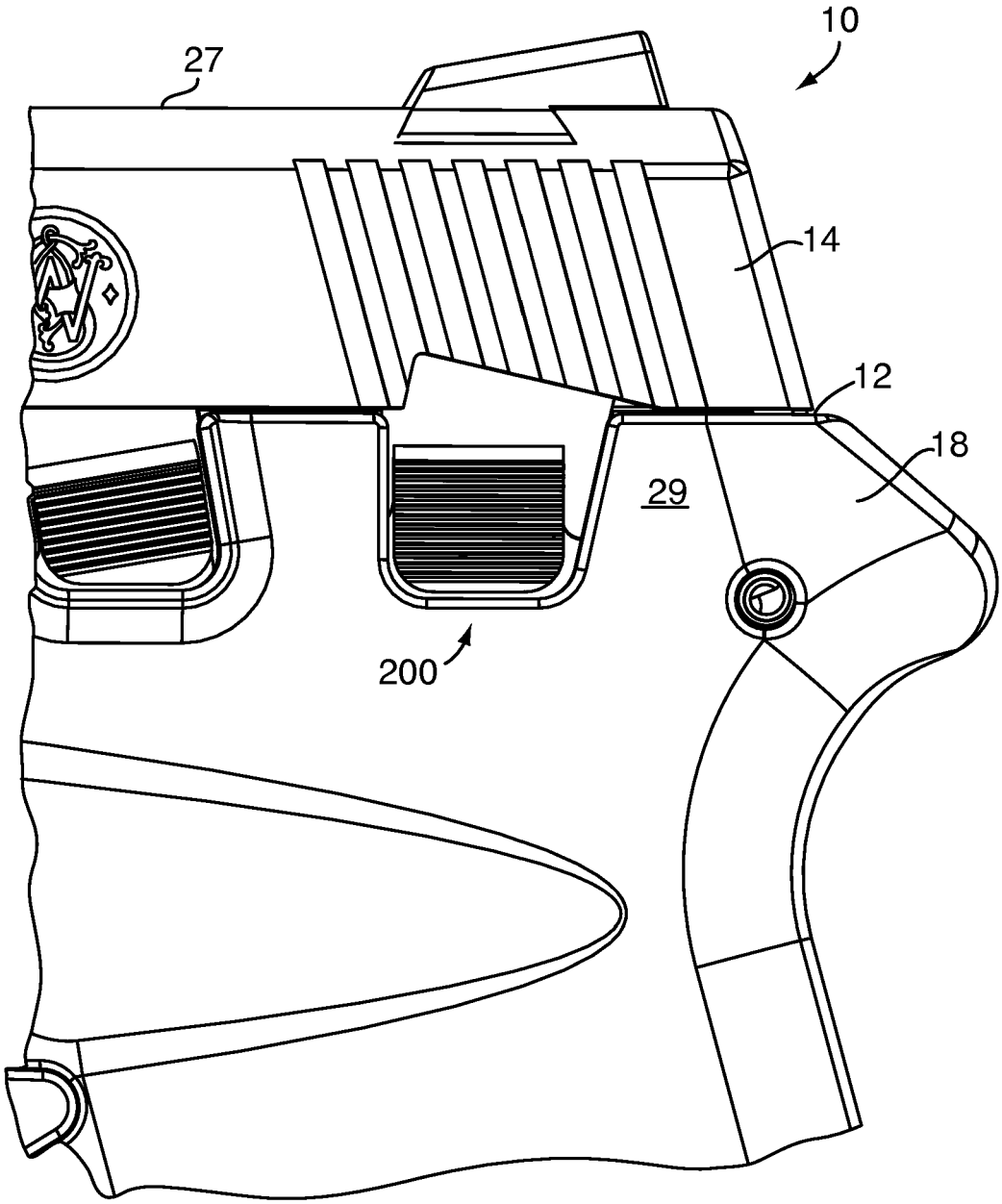
FIG. 9 is a side view of a manual slide and hammer lock safety mechanism according to an embodiment of the present invention such that the manual slide and hammer lock safety mechanism is in the "off" position and the firearm is active.
Figure 10:
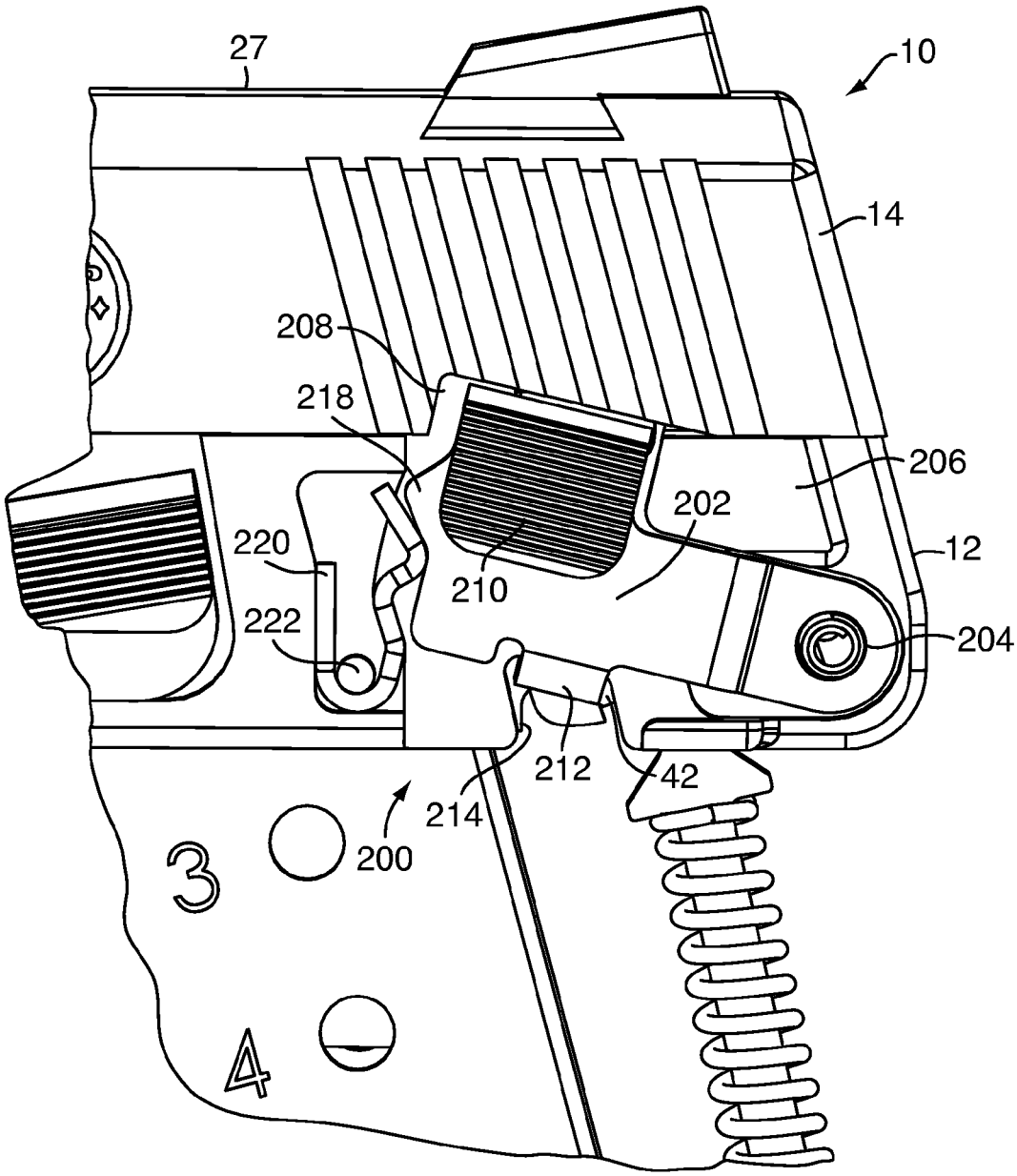
FIG. 10 is a simplified schematic side view of the manual slide and hammer lock safety mechanism according to an embodiment of the present invention such that the manual slide and hammer lock safety mechanism is in the "off" position and the firearm is deactivated, and the grip body has been removed for illustrative purposes.
Figure 11:
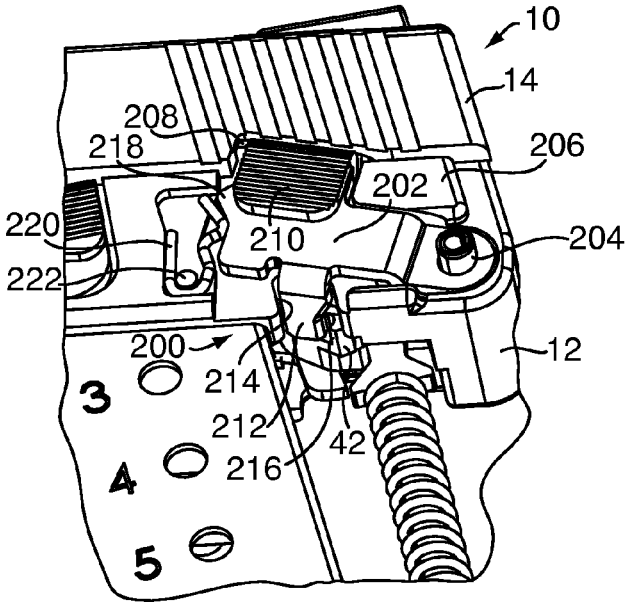
FIG. 11 is a schematic view of the under-side of the manual slide and hammer lock mechanism of FIG. 10.

Referring to FIG. 9-11, the firearm 10 including a manual safety 200 is shown. Referring to FIG. 9, the firearm 10, which, as described above, includes a frame 12, a slide 14 and a grip body 18, is illustrated with the manual safety 200 rotated downward such that the manual safety 200 is in the "off" position and the firearm 10 can be fired.

Referring to FIG. 10, the firearm 10 is illustrated with the grip body removed and the manual safety 200 rotated upward such that the manual safety 200 is in the "on" position and the firearm 10 is deactivated. The frame 12, as shown, includes a frame protrusion 206, which is a molded bulge on the side 29 of the frame 12 to the rear of the firearm 10. The frame protrusion 206 has a generally quadrilateral shape, the upper portion, for example, having a flat edge that abuts the lower edge of the slide 14. The slide 14 includes a slide recess 208, which is a substantially triangular recess in the lower edge of the slide 14, near to the rear of the slide 14.

The manual safety 200 includes a substantially L-shaped tab 202 that rotates, about a tab pivot 204, into and out of the space between a frame protrusion 206 and a slide recess 208. The tab pivot 204 is located below the frame protrusion 206 in the rear corner of frame 12 and is connected to the frame 12, for example, using a mainspring. The tab 202 also includes a grooved portion 210 on the outer side surface of the tab 202 that promotes traction, facilitates manipulation and further blocks the movement of the slide 14 relative to the frame 12.

Referring to FIGS. 10 and 11, the frame 12 also includes a frame recess 214, which is positioned substantially adjacent to the lower end of the hammer 42, below the hammer pin (see FIG. 8). The frame recess 214 forms a substantially quadrilateral opening and provides access to the hammer 42, which includes a hammer recess 216. The hammer recess 216 is formed frontward on a lower edge of the hammer 42.

The tab 202 also includes a tab extension 212 that protrudes laterally from the lower edge of the tab 202 and extends inward into the frame recess 214. The tab extension 212, being integral with the tab 202, is rotatable into and out of the space formed between the hammer recess 216 and a forward edge of the frame recess 214.

When the tab 202 is rotated out of the space between the frame protrusion 206 and the slide recess 208, and the tab extension 212 is rotated out of the space between the hammer recess 216 and the frame 12, the manual safety 200 does not interfere with the operation of the firearm 10. This corresponds with an "off" position of the manual safety 200 (i.e., the firearm 10 is activated), as shown in FIG. 9.

In contrast, the firearm 10 including the manual safety 200 in the "on" position (i.e., the firearm 10 is deactivated) is shown in FIGS. 10 and 11. As shown, when rotated into the space between the frame protrusion 206 and the slide recess 208, the tab 202 prevents movement of the slide 14 relative to the frame 12. Likewise, when rotated into the space between the hammer recess 216 and the frame 12, the tab extension 212 prevents rearward motion of the hammer 42. Accordingly, when the manual safety 200 is in the "on" position, the firearm 10 is deactivated because neither the slide 14 nor the hammer 42 is able to move relative to the frame 12, which prevents the firearm 10 from being cocked either manually by the user pulling back on the slide 12 or inadvertently through a rearward disturbance of the hammer 42.

Since both the tab 202 and the tab extension 212 are physical blocking mechanisms that are only rotatable into spaces formed between elements in the resting or unactuated positions, the manual safety 200 is only operable when the firearm 10 is uncocked. Accordingly, there is no possibility of activating the manual safety 200 while a round of ammunition is chambered and the firing mechanism is cocked. This constraint on the manual safety renders the use of the firearm 10 with the manual safety 200 more predictable.

Referring to FIGS. 10 and 11, the manual safety 200 also includes a biasing mechanism. The biasing mechanism includes a detent spring 220 mounted substantially vertically along the frame 12 that engages a triangular protrusion 218 in the front edge of the tab 202. The detent spring 220 is held in place by a circular frame protrusion 222, as shown. When the manual safety 200 is in the "on" or "off" positions, the detent spring 220 exerts only a slight amount of pressure against the tab 202. However, when the manual safety 200 transitions between the two positions ("on" to "off" or visa versa), the curvature of the triangular protrusion 218 laterally displaces the detent spring 220. In response to this displacement, the natural resiliency of the detent spring 220 exerts a pressure against the edge of the tab 202, which biases the tab 202 toward one of the two positions.

The biasing pressure of the detent spring 220 on the tab 202 makes use of the firearm 10 more predictable by preventing the manual safety 200 from resting in an uncertain intermediate position that might leave the firearm 10 operable.

It should be appreciated that the amount of force required to actuate the manual safety 200 between "on" and "off" positions is primarily determined by the resiliency of the detent spring 220. Therefore, the manual safety 200 can be customized to suit a user's preference by replacing the detent spring 220, which can be performed quickly and easily.

Figure 12:
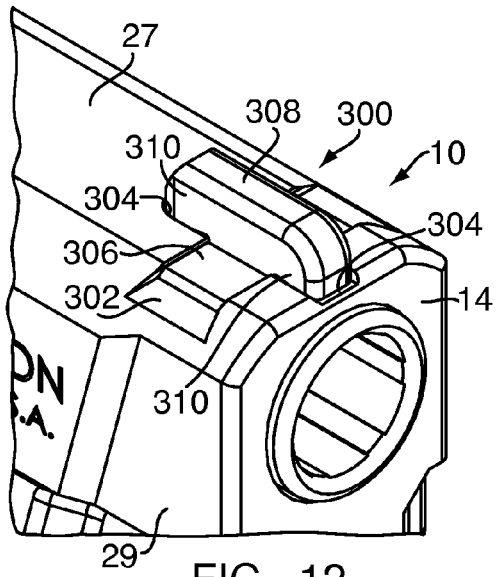
FIG. 12 is a perspective view of a configurable sight according to an embodiment of the present invention.
Figure 13:
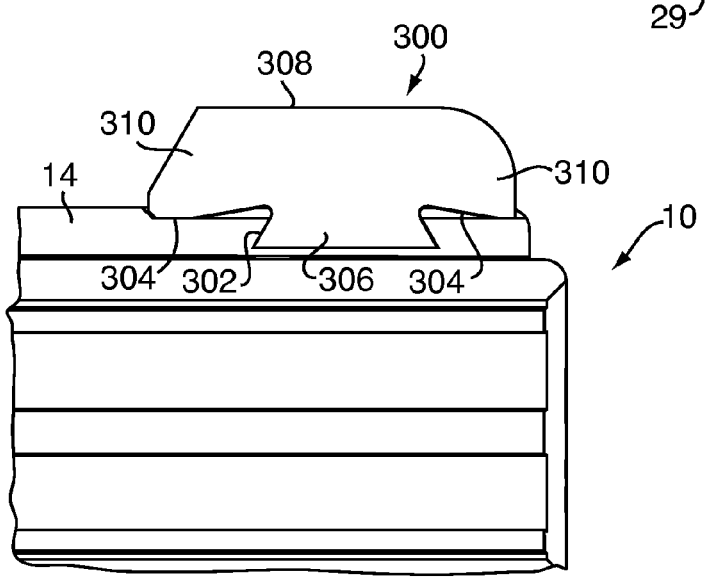
FIG. 13 is a side view of a cross section of the configurable sight of FIG. 12.

Referring to FIGS. 12 and 13, a firearm 10 including the configurable sight 300 is shown. The firearm 10, as discussed above, includes the slide 14 and the longitudinal firing axis 22. In the preferred embodiment, the slide 14 includes a transverse slot 302 that is a dovetail-shaped recess formed laterally in the top surface 27 of the slide 14 near the front end of the slide 14. The slide 14 also includes a pair of longitudinal slots 304 that are flat lap shaped recesses formed along the longitudinal firing axis 22 on both sides of the transverse slot 302. The configurable sight 300 is removably connected to the firearm 10 via the slots 302, 304.

The configurable sight 300 includes a lower portion 306 that is dovetail-shaped and sized to fit the transverse slot 302 and an upper portion 308 having bevel lap-shaped wings 310 that are sized to substantially fit the longitudinal slots 304. The upper portion 308 of the configurable sight 300 facilitates aiming of the firearm 10 among other purposes. The configurable sight 300 is formed of a slightly compliant polymeric material.

To attach the configurable sight 300 to the slide 14, the lower portion 306 is aligned with the transverse slot 302 and the configurable sight 300 is then pressed laterally into the transverse slot 302. As the wings 310 come into contact with the corners or top surface 27 of the slide 14, the wings 310 are deformed upwardly away from the slide 14. By continuing to press the configurable sight 300 laterally through the transverse slot 302, the configurable sight 300 will snap into place aligning with the longitudinal firing axis 22 as the wings 310 expand into the longitudinal slots 304. In other words, the configurable sight 300 snap fits to the slide 14 and, in particular, the wings 310 snap fit to the longitudinal slots 304.

Referring to FIG. 13, a cross section of the firearm 10 including the configurable sight 300 is shown. Preferably, the wings 310 are shaped to extend slightly below the relative height of the longitudinal slots 304 so that the wings 310 remain slightly deformed in the installed position. The persistent slight deformation of the wings 310 strengthens the connection between the configurable sight 300 and the slide 14 by engaging the adjacent dovetailed-shaped faces of the transverse slot 302 and the lower portion 306.

To remove the configurable sight 300 from the slide 14, the lower portion 306 is pressed laterally through the transverse slot 302. As the wings 310 are pressed against the sides of the longitudinal slots 304, the wings 310 elastically deform upwardly to clear the surface of the slide 14. The wings 310 may be pressed upward to facilitate the upward deformation. Accordingly, it should be appreciated that the configurable sight 300 can be quickly and easily attached/detached to the slide 14 by hand without the use of tools.

It should be appreciated that the upper portion 308 can be shaped, sized, and designed in many ways to suit a number of purposes and preferences. Such flexibility of design combined with the ease of installation/removal permits the user to reconfigure the firearm 10 with a different sight to satisfy the user's preferences.

It should also be appreciated that the shape and size of the wings 310, in particular, can be shaped and sized in a number of ways to better engage the longitudinal slots 304. For example, the preferred embodiment has wings 310 of a bevel lap-shaped design. However, wings 310 of a flat lap-shaped or an angular lap-shape design would also be functional.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

For example, it should be appreciated that, in another embodiment, the manual safety 200 can be expanded to both sides of the frame to provide an ambidextrous lock mechanism.

In another embodiment, the outer side surface of the tab 202 has a marking portion for conveying information, such as warnings, instructions, technical specifications, identification or brand information. For example, the tab 202 may be marked with the word "SAFETY" below grooved portion 210. Since the frame 12 is ordinary encased in the grip body 18 (see FIG. 9), this "SAFETY" marking will only be visible while the manual safety 200 is in the "on" position, thereby indicating that the manual safety 200 is engaged and identifying that the tab 202, rather than another component of the firearm 10, should be actuated to deactivate the manual safety 200 and, thus, activate the firearm 10. Alternatively, the tab 202 may be marked above the grooved portion 210 or the frame 12 may be marked under the movement arc of the tab 202 so that the marking is visible while the manual safety 200 is in the "off" position. Such a marking-encasing arrangement permits tab position-specific instructions or markings to be displayed, thereby indicating certain information to the user relating to the current or the alternative positioning.

In another embodiment, the configurable sight 300 can be connected to a similar transverse and longitudinal slot arrangement that is formed in the barrel 20 or a shroud (not shown) rather than the slide 14 (as described above). In yet another embodiment, a configurable sight 300 can be mounted toward the rear of the firearm 10 and therefore act as the rear sight 124.

What is claimed is:

1. A configurable sight for a firearm having a slide, the slide defining a dovetail-shaped transverse slot and a longitudinal slot that connects to the transverse slot and runs parallel to the slide, the configurable sight comprising:

a lower portion that is fitted to the transverse slot; and an upper portion forming a wing that is fitted to the longitudinal slot; wherein the wing snap fits into engagement with the longitudinal slot when the lower portion is inserted into the transverse slot.

2. The configurable sight for a firearm according to claim 1, wherein the lower portion has a dovetail-shape that substantially corresponding to the transverse slot.

3. The configurable sight for a firearm according to claim 1, wherein the wing has a lap-shape that substantially corresponds to the longitudinal slot.

4. The configurable sight for a firearm according to claim 1, wherein the wing further comprises a pair of wings the extend from each side of the lower portion.

5. The configurable sight for a firearm according to claim 1, wherein the configurable sight is made from an elastically deformable material.

6. A configurable sight for a firearm having a top surface with a width and a longitudinal firing axis, the top surface defining a longitudinal slot that runs parallel to the longitudinal firing axis and a transverse slot that connects to each transverse side of the longitudinal slot, the configurable sight comprising:

a lower portion that is fitted to the transverse slot; and an upper portion forming wings that are substantially fitted to the longitudinal slot; wherein the lower portion has a dove-tail shape and extends transversely to the top surface by less than or equal to a width of the top surface; wherein the wings have a flat-lap shape; wherein the wings snap fit into engagement with the longitudinal slot when the lower portion is inserted into the transverse slot; wherein the wings are configured to extend slightly beyond the longitudinal slot; and wherein, when snap fitted into engagement with the longitudinal slot, the wings remain slightly deformed.

7. A method for installing a configurable sight to a firearm, the firearm having a top surface defining a transverse slot and a longitudinal slot connected to the transverse slot, the method comprising:

sliding a lower portion of the configurable sight laterally into the transverse slot until wings of an upper portion of the configurable sight abut the top surface of the firearm;

squeezing the wings in the longitudinal direction to deform the wings away from the top surface; and while squeezing the upper portion, sliding the lower portion further into the transverse slot until the wings snap fit into the longitudinal slot.

8. A firearm having a configurable sight, the firearm comprising:

a slide, the slide defining a dovetail-shaped transverse slot and a longitudinal slot that connects to the transverse slot and runs parallel to the slide, the configurable sight comprising:

a lower portion that is fitted to the transverse slot; and an upper portion forming a wing that is fitted to the longitudinal slot; wherein the wing snap fits into engagement with the longitudinal slot when the lower portion is inserted into the transverse slot.

* * * * *